United States Patent [19]

Segalla et al.

[11] Patent Number: 5,019,216

[45] Date of Patent: May 28, 1991

[54] HEADBOX WITH COARSE AND FINE ADJUSTMENT OF THE SLICE

[75] Inventors: Rodolfo Segalla; Sergio Bottene, both of Schio, Italy

[73] Assignee: Comer S.p.A., Vincenza, Italy

[21] Appl. No.: 562,423

[22] Filed: Aug. 1, 1990

Related U.S. Application Data

[63] Continuation of Ser. No. 355,831, May 22, 1989, abandoned, which is a continuation of Ser. No. 149,113, Jan. 27, 1988, abandoned.

[30] Foreign Application Priority Data

Jun. 25, 1987 [IT] Italy ..... 21054 A/87

[51] Int. Cl.[5] ..... D21F 1/06

[52] U.S. Cl. ..... 162/344; 162/254

[58] Field of Search ..... 162/336–344, 162/347, 259, DIG. 6

[56] References Cited

U.S. PATENT DOCUMENTS

| | | | |
|---|---|---|---|
| 1,497,403 | 6/1924 | Bruner | 162/344 |
| 1,727,928 | 9/1929 | Berry | 162/344 |
| 2,325,016 | 7/1943 | Warren | 162/347 |
| 2,630,045 | 3/1953 | Teale | 162/347 |
| 2,677,991 | 5/1954 | Goumeniouk | 162/344 |
| 3,233,575 | 2/1966 | Williams, Jr. | 162/344 |
| 3,310,461 | 3/1967 | Erbach | 162/344 |
| 3,976,539 | 8/1976 | Kirjavainen | 162/344 |
| 4,517,055 | 5/1985 | Dove | 162/344 |
| 4,517,056 | 5/1985 | Roerig et al. | 162/344 |

*Primary Examiner*—Karen M. Hastings

*Attorney, Agent, or Firm*—Nies, Kurz, Bergert & Tamburro

[57] ABSTRACT

This invention is concerned with a head box in paper machines, including substantially an upper lip, a lower lip, a fibrous slurry flow straightening member connected to a given number of micrometrical control devices which micrometrically adjust the linearity of the flow straightening member, and a mechanism which can be driven by a manually actuated handwheel and which is connected to a hollow beam made integral with the micrometrical control devices whose control rods are supported by said hollow beam, whereby as the mechanism handwheel is actuated, the flow straightening member is subjected to displacements of a given amplitude along a wall adjacent to the upper lip, so that said flow straightening member is made to adjustably project relative to the wall of an amount ranging for instance from 5 to 15 mm, in order to modify the fibrous slurry turbulence.

2 Claims, 2 Drawing Sheets

HEADBOX WITH COARSE AND FINE ADJUSTMENT OF THE SLICE

This application is a continuation of application Ser. No. 355,831, filed May 22, 1989 now abandoned, which was a continuation of application Ser. No. 149,113, filed Jan. 27, 1988, now abandoned.

This invention relates mainly to a head box in paper machines, provided with a mechanism for controlling the fibrous slurry turbulence variation at the outlet thereof, right at the flow straigthening member, close to the moving wire of the paper machine.

The known head boxes are often provided with a flow straightening member, projecting from a wall of said head box, in such a way that said projection creates a predetermined fibrous slurry turbulence, whereby the fibre interlacement becomes oriented only in a given way. It is also known that said flow straightening member needs to be perfectly parallel to the head box lower lip, so that the paper web which is formed has a constant thickness over the whole length thereof. In order to achieve the above object, micrometrical control devices are known which are adapted to micrometrically adjust the flow straightening member linearity. Obviously, said infinitesimal displacements of the flow straightening member, over the whole length thereof, cannot cause an outcoming fibrous slurry turbulence variation, just because of the minimum amplitude of the flow straightening member displacements.

A device adapted to obtain said flow straightening member micrometrical adjustments is shown in U.S. Pat. No. 4,517,056.

The head boxes of the type disclosed in the Patent mentioned above have a drawback of not being provided with any means adapted to control the paper fiber slurry turbulence variation, this feature being in fact considered very important in order to control the fiber interlacement or orientation according to the type of slurry available and to the type of paper that should be produced. Therefore, by means of the previous art head box optimum results are obtained only when dealing with a single type of slurry, but as the latter changes the results become unsatisfactory.

It is an object of this invention to overcome the drawbacks mentioned above by providing a head box having a mechanism provided with the following advantageous features:

it enables the fibrous slurry turbulance at the head box outlet to be modified;

it can be easily applied to a head box provided with micrometrical head box flow straightening member linearity adjustment, and the design arrangement thereof is cost effective, and it does not require frequent maintenance interventions.

These and further objects are all achieved by means of the subject head box, which includes an upper lip, a lower lip, and a fibrous slurry flow straightening member connected to a certain number of micrometrical control devices provided with control rods adapted to micrometrically adjust the flow straightening member linearity, characterized in that said flow straightening member is additionally connected to a mechanism adapted to subject said flow straightening member to given amplitude displacements along a wall adjacent to the upper lip, whereby the mechanism causes the flow straightening member to adjustably project from said wall, in order to modify the fibrous slurry turbulence. A further feature resides in that said mechanism, usually, hand controlled, is connected to a beam made integral with said micrometrical control devices, and in that this beam is hollow, and it is adapted to support the control rods for the micrometrical control devices.

BRIEF DESCRIPTION OF THE DRAWINGS

The features and advantages of this invention will become apparent from the following detailed description of a preferred but not exclusive embodimental form of the subject head box, shown only for exemplary and non limiting purposes in the attached drawing, wherein:

Referring now to FIGS. 1 and 2, the subject head box 1 includes, in a way known per se, an upper lip 2, a lower lip 3 and a flow straightening member 4 for the fibrous slurry which flows between the upper lip and the lower lip, according to the direction of arrow A, and exits through the opening defined by the flow straightening member 4 and by lower lip 3, in order to flow out on a wire 5 wrapped about a roll 6 rotating in the direction of arrow B.

Figure 1:
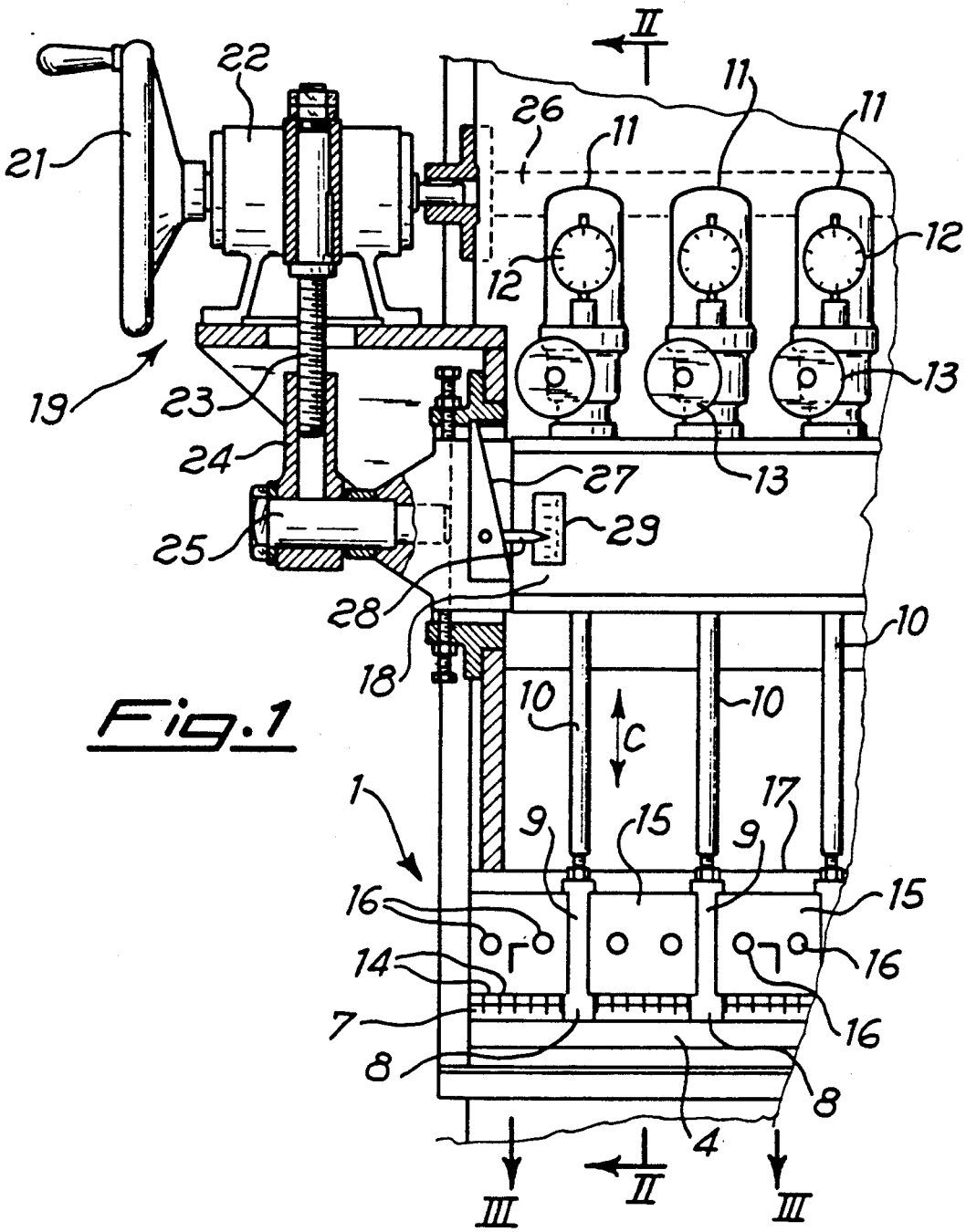
FIG. 1 is an elevational view, partially in cross section, of the head box and of the subject mechanism.
Figure 3:
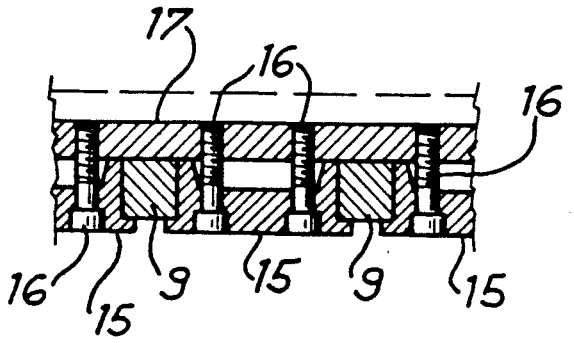
FIG. 3 is an enlarged scale cross section of a detail along line III—III of FIG. 1.
Figure 4:
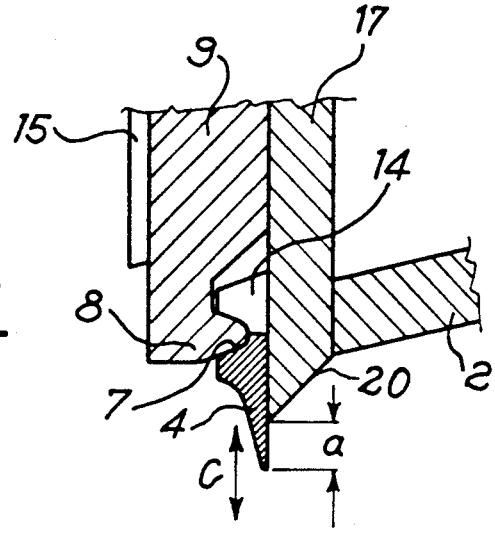
FIG. 4 is an enlarged scale detail of FIG. 2.

Flow straightening member 4 is provided with a longitudinal groove 7 wherein, as shown in FIGS. 1 and 4, there is received the ends 8 of a plurality of arms 9 respectively fastened to control rods 10 of micrometrical devices 11, which are individually provided, in a known fashion, with a dial indicator 12, showing the micrometrical displacement of each arm 9, and with an adjusting knob 13. Through proper actuation of said knobs 13, micrometrical adjustment of the linearity of flow straightening member 4 is achieved. In addition, the latter has transverse grooves 14 adapted to provide the flow straightening member with a certain amount of resiliency which is required in that said arms 9 are held in compression, at ends 8 thereof, against flow straightening member 4 by means of plates 15 held into abutment against stationary wall 17, integral with upper lip 2, by means of screws 16 threaded through said wall. Micrometrical control devices 11 are fastened to a hollow beam 18 having control rods 10 fitted therein, for micrometrical sliding adjustments in the direction of double arrow C, the adjustments being reflected onto flow straightening member 4, in order to achieve linearity over the whole length thereof.

Figure 2:
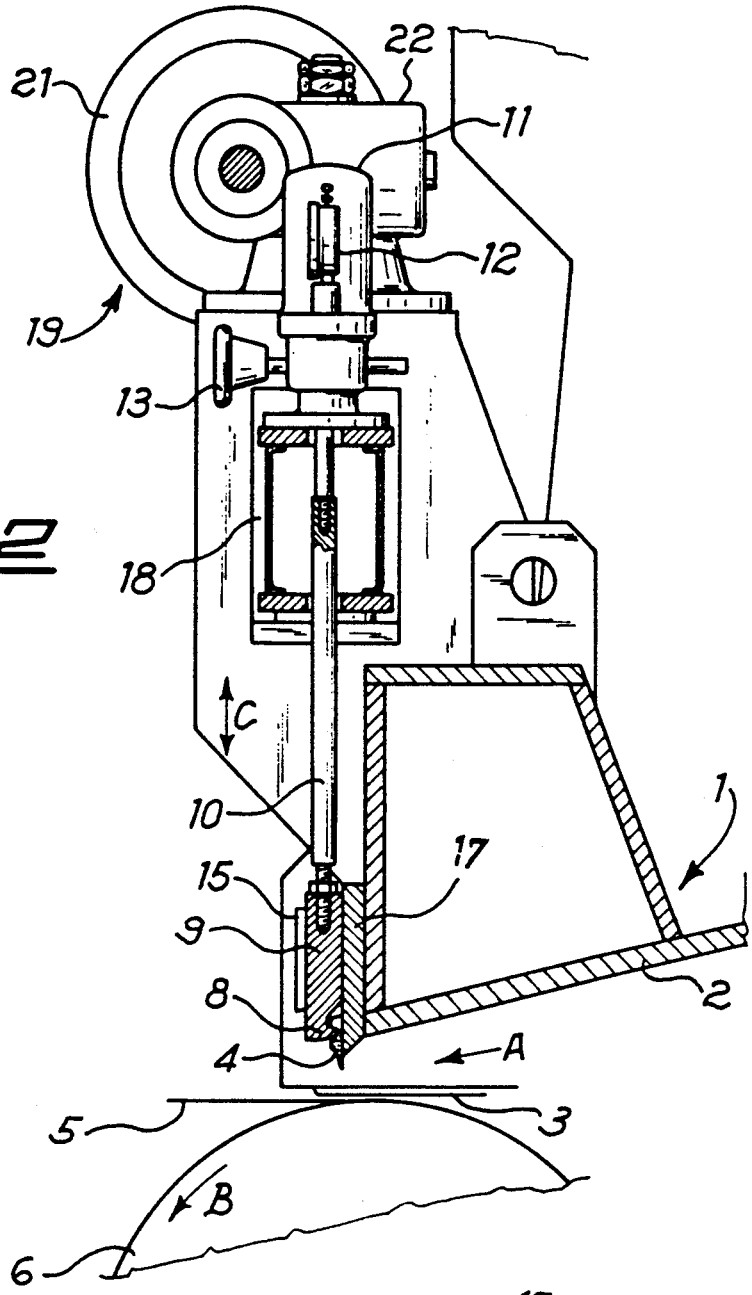
FIG. 2 is a vertical section of the head box, along line II—II of FIG. 1.

According to the object of this invention, flow straightening member 4 is additionally connected to a mechanism 19 adapted to subject the flow straightening member to displacements of a given amplitude along stationary wall 17 which is provided with a sloping face 20. As shown in FIGS. 2 and 4, the upper lip 2 has an inclined face in the flow direction, and sloping face 20 is angularly inclined relative to the upper lip face.

In this way, the flow straightening member 4 is made to project, relative to said wall 17, of a length "a" which is for instance controllably variable in the range from 5 to 15 mm, in order to modify the turbulence of the fibrous slurry flowing between upper lip 2 and lower lip 3, along the direction of arrow A. The mechanism 19 includes a manually actuated handwheel 21 fastened to a worm screw-helical wheel set enclosed in a support 22, whereby threaded shaft 23 set into rotation by said worm screw-helical wheel arrangement displaces hub 24 associated therewith, in the directions of double arrow C, in integral connection with a bolt 25 which is in turn integrally connected with beam 18.

Handwheel 21 is made integral with a horizontal shaft 26 which sets into motion a worm screw-helical wheel arrangement, similar to the one described above and shown at reference number 19, whereby beam 18 moves along the direction of arrow C, being actuated by bolt 25 and further by another similar bolt, not shown in the Figure, being located on the opposite side from the handwheel 21. To head box 1 there is fastened, in addition to support 22, also a bracket 27 integrally connected to an indicator 28 moving in front of a dial plate 29, fastened to beam 18.

Operation is as follows: according to the type of slurry and to the type of paper which has to be manufactured, and therefore in order to modify the slurry turbulence and the degree of interlacement and orientation of the slurry fibers, handwheel 21 is rotated in one of the two directions, whereby flow straightening member 4 is made to project of a required amount "a" relative to wall 17. After this adjustment has been made, whereby flow straightening member 4 is subjected to a displacement of a given amplitude bringing member 4 to project from 5 to 15 mm relative to wall 17, provision is made, through micrometrical control devices 11, to adjust the flow straightening member linearity. Indicator 28, together with dial plate 29, can be used to re-establish the same amount of relative displacement "a" in case there is a requirement to go back to processing a type of slurry identical to the one previously processed.

Practical variations and design modifications may be made to this invention without exceeding the scope thereof, as claimed herein.

What is claimed is:

1. A headbox for a paper machine, said headbox comprising: an upper lip and a lower lip, a wall member of said upper lip forming with said lower lip a flow path for fibrous slurry, a straightening member on said wall member projecting into said path from said wall member, wherein said upper lip has a face inclined in the direction of the flow path and said wall member has a bottom face angularly inclined relative to said upper lip face and sloping down to said straightening member, a plurality of micrometrical devices individually controlled connected by means of control rods to said flow straightening member at spaced points along the length thereof to fine-adjust the linearity of said flow straightening member and a beam supporting said devices, wherein said headbox includes turbulence control means for modifying the turbulence of said flow, said turbulence control means including means for coarse-displacing said beam up and down in a vertical direction simultaneously with said control rods and said straightening member to thereby adjustably move said flow straightening member through strokes of given coarse amplitudes along said wall to coarse-adjustably project said flow straightening member a length relative to said wall into said path to modify the turbulence of the slurry flow passing therethrough.

2. The headbox of claim 1 including a handwheel connected to said coarse-displacing means which are located at both sides of said beam.

* * * * *